United States Patent [19]

Griesmer et al.

[11] Patent Number: 4,748,649

[45] Date of Patent: May 31, 1988

[54] PHOTOTIMING CONTROL METHOD AND APPARATUS

[75] Inventors: Jerome J. Griesmer, Kirtland; Hugh T. Morgan, Highland Heights, both of Ohio

[73] Assignee: Picker International, Inc., Cleveland, Ohio

[21] Appl. No.: 893,574

[22] Filed: Aug. 4, 1986

[51] Int. Cl.[4] ..... H05G 1/42

[52] U.S. Cl. ..... 378/97; 378/108; 378/118

[58] Field of Search ..... 378/97, 108, 118

[56] References Cited

U.S. PATENT DOCUMENTS

| | | | |
|---|---|---|---|
| Re. 26,497 | 12/1968 | Splain . | |
| 2,486,866 | 11/1949 | Morgan et al. . | |
| 2,942,114 | 6/1960 | McNally | 378/97 |
| 2,993,123 | 7/1961 | Ball | 378/97 |
| 3,444,378 | 5/1969 | Cibula et al. | 378/97 |
| 3,444,379 | 5/1969 | Bergson . | |
| 3,600,584 | 8/1971 | Schneble | 378/97 |
| 3,752,991 | 8/1973 | Slagle | 378/97 |
| 4,121,104 | 10/1978 | Richter | 378/97 |
| 4,178,508 | 12/1979 | Hotta et al. . | |
| 4,230,944 | 10/1980 | Wiegman et al. | 378/97 |
| 4,250,103 | 2/1981 | Vatne et al. . | |
| 4,309,613 | 1/1982 | Brunn et al. . | |
| 4,313,055 | 1/1982 | Richter et al. . | |
| 4,454,606 | 6/1984 | Relihan . | |
| 4,590,603 | 5/1986 | Relihan et al. . | |

*Primary Examiner*—Craig E. Church

*Assistant Examiner*—John C. Freeman

*Attorney, Agent, or Firm*—Timothy B. Gurin

[57] ABSTRACT

An improved phototimer control and compensation scheme is provided. The control monitors electrical signals produced by a plurality of photomultiplier tubes. PMT dark current is sampled prior to exposure and is compensated for as exposure begins. Each PMT produces a signal proportional to incident radiation which is integrated by separate integrator means to produce first ramp signals. Switching means are provided for selecting any one or combination of first ramp signals. Mixing means combines selected first ramp signals. Amplifier means amplifies mixed signals as a function signals selected to produce a second ramp signal. Gain selection means compensates the gain of the second ramp signal to the speed with the film-screen combination chosen. An exposure compensation scheme produces an exposure reference signal defining the net effect of system variables. Equations defining kV reference curves are stored in a first storage means. Digital data values representing characteristics of different film-screen combination are stored in a second storage means. A processor develops a kV ramp reference signal base on one of the kV reference curves and data values. Scaling factor equations and values representative of system variable are also stored in the first and second storage means. The processor includes means for developing scaling factor which compensate the reference signal for the effect of system variables on film density.

13 Claims, 6 Drawing Sheets

PHOTOTIMING CONTROL METHOD AND APPARATUS

CROSS REFERENCE TO RELATED APPLICATIONS

IMPROVED PHOTOTIMING METHOD AND APPARATUS, U.S. patent application Ser. No. 893,573 filed on Aug. 4, 1986 and owned by the present assignee.

TECHNICAL FIELD

The present invention relates generally to the field of radiation imaging and more particularly to a method and apparatus for controlling the automatic timing of exposures to X-radiation.

BACKGROUND ART

Automatic phototimers of the type having a fluorescent screen positioned behind or beneath a subject in the path of an x-ray beam together with one or more phototubes which receive the light from the screen are well known. An example of one such phototimer is described in U.S. Pat. No. 3,752,991 to Slagle, owned by the present assignee and which is hereby incorporated by reference.

The purpose of a phototimer is to terminate an x-ray beam when a film cassette, positioned in the beam, has received an exposure that will produce an image on the film of desired density in the zone of the "active" sensing area.

To control the timing of the exposure, a phototube receives light generated by incident radiation on a scintillator screen. The phototube generates a signal proportional to the radiation dose incident on the screen. The signal is integrated over time and compared to a reference signal. When the integrated signal reaches a level equal to the reference signal, a termination signal effective to terminate the exposure is produced.

Traditionally, the reference signal was produced using a simple kVp density compensation scheme, i.e., the reference signal varied as a linear function of selected kVp. For a low range of selectable kVp, e.g., 50–75 kVp, the value of the reference signal declined linearly as selected kVp increased. Over a second range, e.g., 76–150 kVp, the value of the reference signal was a predetermined constant value. Density variation in the resultant image was achieved by shifting the reference signal versus kVp curves up or down by a factor corresponding to the desired density variation.

A simple linear relationship between selected kVp and the reference signal has proved inadequate to properly compensate for variation in film density over the range of selectable kVp. Additionally, breaking the compensation scheme down to only two regions has not provided the desired degree of control. Also other factors besides selected kVp and desired variation in film density need to be considered in the overall compensation scheme.

In another compensation scheme described in U.S. Pat. No. 4,454,606 compensation curves representative of plots of reference signal v. exposure time can be reconfigured to account for the variable effects on x-ray film density resulting from a variety of system parameters. This scheme is useful in providing compensation for short (e.g., <20 ms) exposure intervals but is inadequate for longer exposure and doesn't adequately account for kVp density variations.

It has also been found desirable to provide a control circuit which can selectively integrate a plurality of PMT signals, compensate these signals for stray leakage currents such as PMT dark current, mix the selected signals, selectively amplify and gain factor the mixed signal to account for the number of phototimer fields selected and the speed of the film and intensifier screen chosen.

In the above referenced Slagle patent, a multi-field, single PMT system is described. Movable shielding means, which formed a part of the photomultiplier tube housing structure, was utilized to selectively block the transmission of light from the field to the single PMT. The use of a single phototube results in less than optimum light collection efficiency from the sensing areas since only a portion of the light sensitive area of the phototube is energized. Further, the movable shielding means comprise moving parts that are prone to wear resulting in poor long term performance and reliability.

In other phototimer designs, automatic compensation of a number of error causing signals associated with a photomultiplier tube, e.g., dark current, was provided. An example of one such compensation scheme can be found in U.S. Pat. No. 3,600,584 which describes dark current compensation of a single field, single tube device.

Other single detector devices provide means for varying the gain of the integrated output to account for different film speeds commonly used. An example of one such device is U.S. Pat. No. 4,250,103.

In yet other designs, multiple fields are provided. Means for selecting any one of the fields or any combination of the fields is provided. An example of one such device can be found in U.S. Pat. No. 4,230,944.

None of these designs offer the advantage of combining all of the features into a single control circuit in order to achieve the reliability, flexibility and control over the exposure offered by the present invention.

SUMMARY OF INVENTION

In accordance with the present invention a new and improved phototimer control circuit is provided. The control means is coupled to a multiple field phototiming device and monitors electrical signals produced by each photomultiplier tube associated with each of the phototimer fields. Dark current produced by each photomultiplier tube is sampled prior to the initiation of an exposure and is compensated for as the exposure begins. Upon initiation of an exposure each photomultiplier tube produces an electrical signal proportional to radiation incident on its associated phototimer field. Each such signal is integrated over time by separate integrator means to produce first ramp signals. Switching means are provided for selecting any one or any combination of the first ramp signals. Mixing means is also provided to combine the selected first ramp signals and amplifier means amplifies the mixed signal as a function of the number of fields selected to produce a second ramp signal. Gain selection means is also provided to compensate the gain of the second ramp signal in accordance with the speed of the film screen combination selected.

In accordance with another aspect of the present invention a method for producing an exposure reference signal defining the net affect of a plurality of system variables is provided. A first set of equations defining kV reference curves having selected kVp as variables and value representations of film and speed screen as coefficients are stored in a first storage means. In a second storage means, digital data values representing the characteristics of a plurality of different film/screen combinations are stored. A processor capable of accessing the first and second storage means develops a kV ramp reference signal based on one of the kV reference curves and the digital data values representing one of the film/screen combination.

The kV ramp reference is used in comparison with the third ramp signal to produce a signal effective to terminate the exposure.

In accordance with a more limited aspect of the present invention, the first set of equations defining kV reference curves define three kV compensation regions. The curve defining the first region is a portion of a parabola. The curve defining the second region is also a portion of a parabola. The curve defining the third region is a line.

In accordance with a more limited aspect of the present invention a method of scaling the kV ramp reference is provided to compensate for at least one of a plurality of predetermined system variables. The first storage means also includes means for storing a plurality of scaling factor equations. The second storage means also includes means for storing a plurality of value representative of the predetermined system variables. The processor means also includes means for developing scaling factors based on the scaling factor equation and the values of the selected system variables. The kV ramp reference is multiplied by the product of the scaling factors to produce a ramp reference signal.

One advantage of the present invention is that it provides a phototimer control circuit having a reference signal versus kVp compensation scheme which is more readily compensated to correlate with actual variations in system performance.

Another advantage of the present invention is that it provides a control circuit for a multi-field, multi-photomultiplier phototimer which can correct photomultiplier dark current, compensate for the combination of fields chosen and compensate for the speed of the film/screen selected by the operator.

Yet another advantage of the present invention is to provide a phototimer control circuit which is operable over a wide range of temperature and humidity.

Still further advantages will become apparent to those of ordinary skill in the art upon reading and understanding the following detailed description of the preferred embodiment.

BEST MODE FOR CARRYING OUT THE INVENTION

Figure 1:
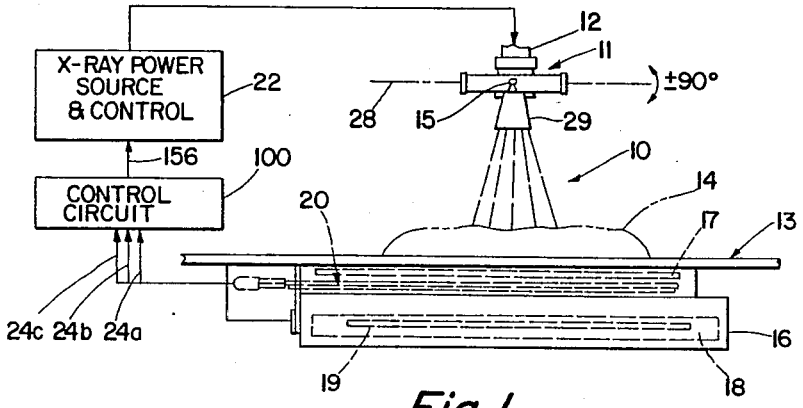
FIG. 1 is an elevational view and partial block diagram of an x-ray apparatus with the improved phototimer device of the present invention shown mounted beneath an examination table within the path of x-rays which have passed through a subject.

Referring to the drawings and initially to FIG. 1, an x-ray apparatus is shown generally at 10. The apparatus includes an x-ray tube, not shown, mounted within a protective tube housing 11. The tube and its housing 11 are supported in an operative position by a suitable supporting structure 12. The tube is supported on the supporting structure for tilting rotation about a horizontal axis 28 over a range of ±90°.

A subject supporting table 13 is disposed beneath the tube housing 11. The position of a subject to be examined is indicated in broken lines generally at 14. Means for energizing the tube to emit radiation and for selecting and controlling the desired x-ray tube factors such as voltage (kVp), tube current, x-ray tube focal spot size are symbolized by a block 22 labeled x-ray power source and control. This block includes the necessary circuitry to control energization of the x-ray tube in a predetermined manner. An x-ray exposure is generally initiated by energizing the x-ray tube through the use of an operator controlled hand switch. When an exposure is initiated, the x-ray tube emits x-rays in a beam emanating from a focal spot shown schematically at 15 and directed toward the subject 14 positioned on the table 13.

A cassette carrying assembly 16 is positioned beneath the table 13. The cassette carrying assembly 16 is equipped with either the usual reciprocable or stationary grid 17 and a cassette or film tray 18. A cassette 19 carrying x-ray sensitive film and scintillation screen is positioned within the film tray 18 such that X-rays passing through the subject 14 will cast a shadow which is recorded by the film in the cassette 19. The x-ray film and scintillation screen combination are chosen by the operator. Different sensitivities to x-rays or "speeds" can be chosen depending on the type of examination to be performed, the particular anatomy to be examined and the exposure technique factors to be chosen.

A collimator 29 of known type is mounted to the tube housing 11. The collimator delineates the perimeter of the x-ray beam to correspond to the x-ray film size. Variable collimators are typically used which permit continuous variation of the x-ray field size within the limits of the collimator mechanism. The collimator includes means (not shown) for producing signals corresponding to the size of the selected x-ray field.

A phototimer assembly 20 is secured to the top and one side of the cassette or film tray 18. The phototimer assembly 20 receives radiation emerging from the subject under examination and produces one or more electrical signals, shown generally at 24 each of which is proportional to the radiation intensity incident on selected portions or fields of the phototimer assembly.

A control circuit represented by block 100 receives each of the electrical signal 24 and produces a exposure termination signal 26. The control circuit is described in more detail below. The termination signal 156 is connected to the x-ray power source and control 22 and is effective in causing the termination of the exposure after a predetermined dose to the film has been measured.

The phototimer assembly and control circuit permit uniform film densities to be achieved during x-ray exposures so that any combination of phototimer fields, film/scintillator screen speed, film or image size, technique factors, patient size, focal spot size or beam angle will give consistent results.

Figure 2:
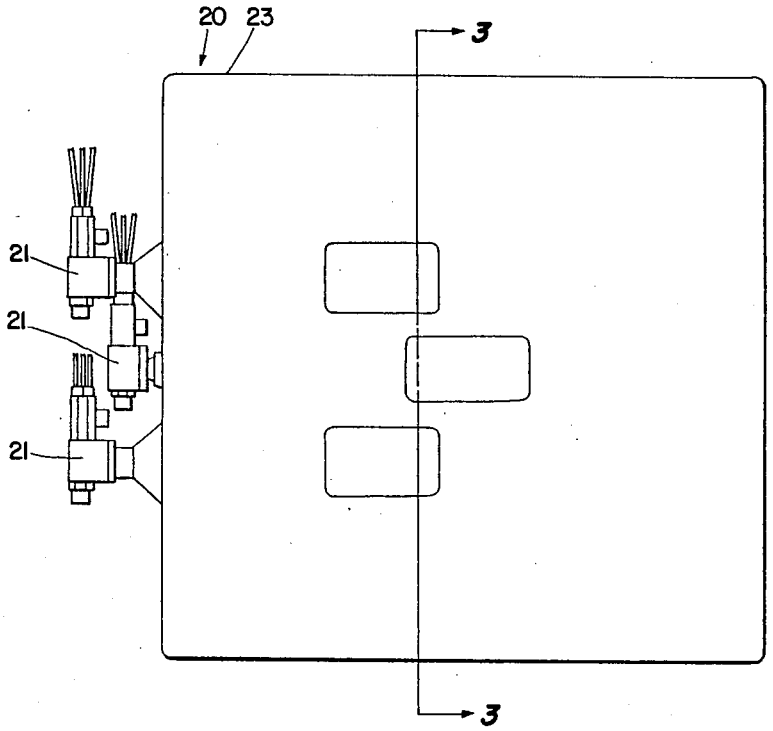
FIG. 2 is a plan view of the phototiming assembly of the present invention.

Referring to FIG. 2, the phototimer 20 is shown in more detail. Phototube housing assemblies 21 each contain a single, suitable light responsive electrical control element such as a photomultiplier tube. Paddle housing assembly 23 contains a paddle assembly 25 (see FIG. 3) which includes a rare earth scintillation screen 32, a plurality of panels 27 which transmit light to the phototubes and a mask 30. The phototube housing assemblies 21, the paddle assembly 25 and the paddle housing assembly 23 will be described in greater detail below.

Figure 3:
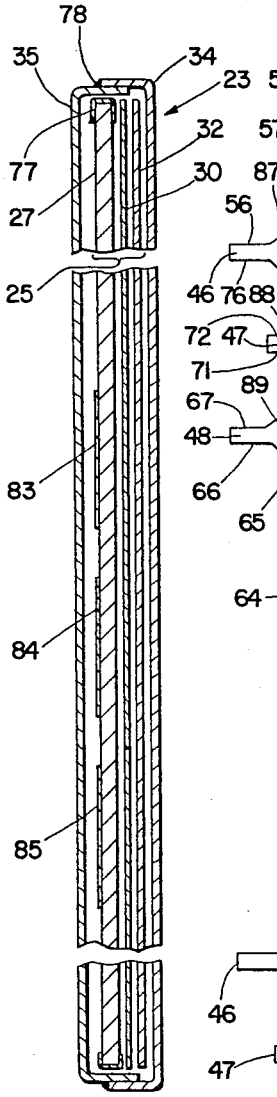
FIG. 3 is an expanded, sectional view of the paddle housing assembly as seen from the plane indicated by the line 3—3 in FIG. 2.

Referring to FIG. 3, the construction of the paddle housing assembly 23 and paddle assembly 25 is more clearly shown in an expanded sectional view. A light transmitting assembly 27 is positioned at the bottom of the paddle assembly 25 and comprises a plurality of juxtaposed panels as will be explained below. The paddle mask 30 is sandwiched between the light transmitting assembly 27 and a rare earth scintillation screen 32. The entire paddle assembly 25 is in turn sandwiched between upper and lower covers 34, 35. The cover 34 is referred to as the upper cover in that it is positioned facing upwardly toward the focal spot 15 (see FIG. 1). Cover 35 is slightly smaller than cover 34 allowing cover 35 to fit inside cover 34 in a mating fashion.

Figure 4:
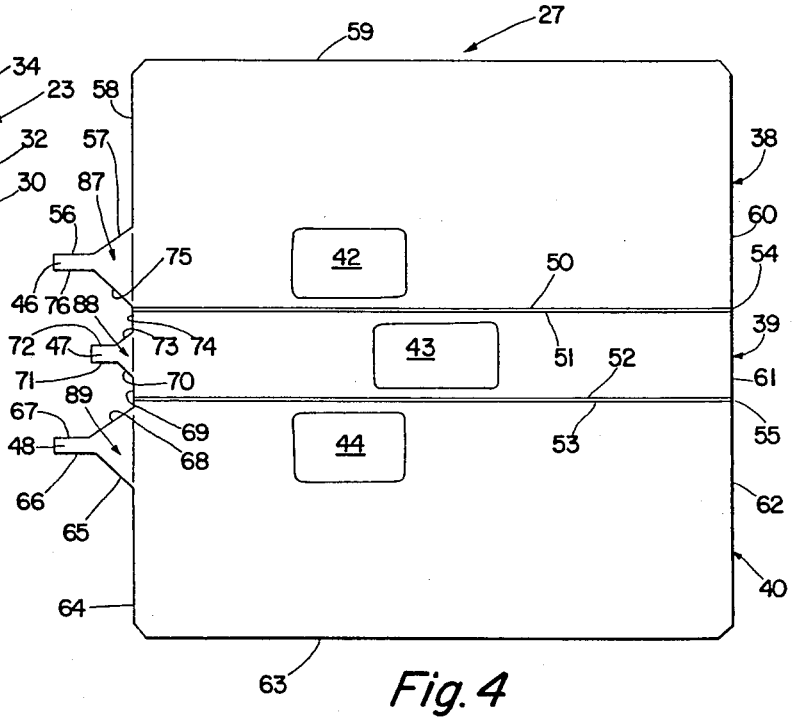
FIG. 4 is a plan view of the juxtaposed light transmitting panels used in the assembly of FIGS. 2 and 3.

Referring now to FIG. 4, the light transmitting assembly 27 is shown in more detail. The paddle structure comprises three juxtaposed light transmitting panels 38, 39, 40. The panels 38, 39, 40 are formed of transparent material of a high refractive index such as Plexiglas. This material has the characteristic that light received within any portion of the panel is transmitted, through internal reflection, to the edges of the panel. The present invention utilizes this characteristic of Plexiglas to transmit light from light input areas 42, 43, 44 to light output areas 46, 47, 48 respectively.

The panels 38, 39 have abutting edges 50, 51. The panels 39, 40 have abutting edges 52, 53. In order to prevent the transmission of light between the panels 38, 39, 40 and to join the panels together at the edges, thin strips of black, opaque Plexiglas 54, 55 are bonded, using an acrylic monomer adhesive to edges 50, 51 and 52, 53 respectively. The perimetral edges 56–76 are coated with white paint or reflective aluminum tape 77 (see FIG. 3) to further preserve the integrity of the light signals received within the individual panels.

Figure 5:
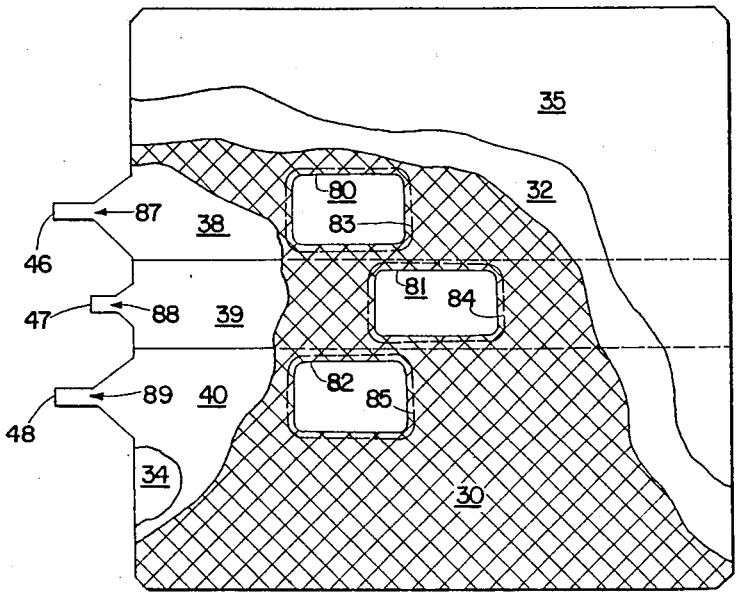
FIG. 5 is a plan view of the paddle housing assembly of FIGS. 2 and 3 with portions thereof broken away to illustrate details.

Referring to FIG. 5, the paddle housing assembly 23 and paddle assembly 25 are shown as viewed from below with components broken away to illustrate the details of assembly. The upper and lower covers 34, 35 comprise molded sheets of styrene which are black in color to absorb light. Styrene is used in place of the fiberboard used in prior art devices since styrene does not absorb moisture and is therefore usable in conditions of high humidity. During assembly, a complete paddle assembly 25 is placed in the lower cover 35. Filler blocks (not shown) are placed between the perimetral edges of paddle assembly 25 and the inside edges of lower cover 35 to maintain a snug fit between the two. Upper cover 34 is placed over the paddle assembly 25 and mated with lower cover 35. Black plastic rubber, preferably methyl ethyl ketone and petroleum distillates is injected between the mating edges of the covers 34, 35 in a continuous bead 78 around the entire perimeter of the covers (see FIG. 3). The bead 78 binds the covers 34, 35 together while forming a humidity proof, light tight seal.

The fluorescent screen 32 comprises a thin (0.011") reflectorized polyester base which is coated with a rare earth scintillating phosphor. The preferred phosphor is a blend of gadolinium and yttrium oxysulfides activated with terbium (i.e. $Gd_2O_2S:Tb/Y_2O_2S:Tb$). The preferred coating weight is 5 mg/cm$^2$. The use of a rare earth phosphor results in an increased light output per absorbed x-ray (conversion efficiency) with a reduced coating weight to lower attenuation. The fluorescent screen constructed in this fashion offers improvements in x-ray transmission and conversion efficiency over the prior art devices. The screen 32 transmits greater than 95% of the incident primary radiation for a 80 kVp, 7 mm aluminum Half Value Layer (HVL) beam quality. The screens conversion factor exceeds $1\times10^{-5}$ Cd/M$^2$/mR/Min. at 80 kVp, 7 mm HVL x-ray beam. Other scintillating phosphors such as gadolinium oxysulfide, yttrium oxysulfide, calcium tungstate, cadmium tungstate may also be useful in this application.

The choice of materials that comprise screen 32 offer other advantages as well. The k-edge of gadolinum oxysulfide is 50 kev. The use of materials with a k-edge in the range of 40 to 90 kev will modify the x-ray spectrum by preferentially filtering a portion of the high energy beam or "hard" x-rays while leaving intact the medium and low energy beam or "soft" x-rays. This has the effect of improving the contrast of the resultant x-ray image produced on film 19.

In an alternate embodiment of the present invention, the rare earth scintillating material can be deposited directly to the face of the light transmitting assembly 27 thereby eliminating the polyester substrate. The Plexiglas panels 38, 39, 40 are used as the base for the scintillator.

The mask 30 comprises a sheet of black, styrene plastic which is opaque to light. The styrene material is preferred over the fiberboard paper mask of the prior art device for the same reasons as covers 34, 35. Rectangular openings 80, 81, 82 are formed through the mask 30 adjacent the light input areas 42, 43, 44 of panels 38, 39, 40. The mask 30 thereby serves to limit the transmission of light from the fluorescent screen 32 to that which passes through the openings 80, 81, 82.

The panels 38, 39, 40 serve to collect the light passing through the mask openings 80, 81, 82 and transmit it to the respective light output areas 46, 47, 48. It is important to note that any reduction in the number of internal reflections the received light must make on its way to a light output area leads to a direct increase in the light intensity at the light output area.

In order to improve the light collection efficiency of the panels 38, 39, 40 the surfaces of the panels opposite the mask openings are coated with rectangular areas of reflective white paint as indicated by broken lines 83, 84, 85 in FIG. 5 (also see FIG. 3). These coatings 83, 84, 85 are deposited directly on panels 38, 39, 40 on the sides adjacent the lower cover 35. By this arrangement, light passing through mask openings 80, 81, 82 from the fluorescent screen 32 and into the panels 38, 39, 40 is diffused and reflected back into the panels.

The light output areas 46, 47, 48 receive light directly from the light input areas 42, 43, 44. The position of a light output area along the edge of its respective panel in relation to the position of the corresponding light input area is critical to an improvement of the device of the present invention over the prior art. Funnel portions 87, 88, 89 collect light transmitted from light input areas 42, 43, 44. The funnel portions 87, 88, 89 and thus light output areas 46, 47, 48 are positioned along an edge of panels 38, 39, 40 such that the distance light must travel from a light input area to its corresponding funnel portion and thus its corresponding light output area is minimized. In other words, for maximum light intensity at output areas 46, 47, 48, a line running from the center of an input area 42, 43, 44 to the center of a corresponding output area 46, 47, 48 should be perpendicular to a perimetral edge of a panel 38, 39, 40. This direct path from light input to light output area provides an increase in light intensity at the output thereby increasing the conversion efficiency of the device.

Figure 6:
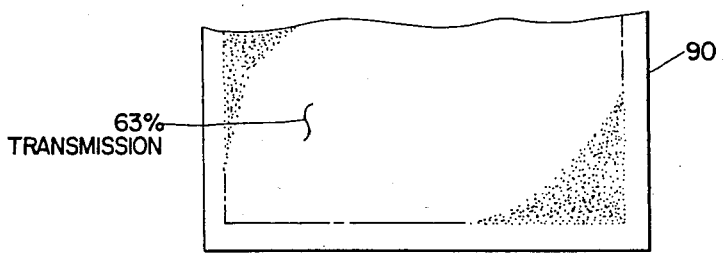
FIG. 6 is a plan view of a light attenuation means which may be employed in the assembly of FIG. 2.

It is known that light which enters panels 38, 39, 40 near the light output areas 46, 47, 48 will produce a more intense light signal in the output areas 46, 47, 48 than light which enters farther from the output areas 46, 47, 48. It is therefore necessary to provide a light attenuation means to equalize the output effect of all light entering the light input areas 42, 43, 44. For this purpose, a light attenuation screen having a uniform dot pattern may be placed over a portion of the input areas 42, 43, 44 to attenuate the light passing from the fluorescent screen 32 into the panels 38, 39, 40. Such an attenuation screen is shown generally at 90 in FIG. 6. The attenuation screens 90 are secured to the mask 30 on the side adjacent fluorescent screen 32 over a portion of rectangular openings 80, 81, 82 nearer the output areas 46, 47, 48 so as to attenuate the light passing from the screen 32 to the input area 42, 43, 44. Other light attenuation screens having openings which increase in size from one side to another may also be used.

The parallel abutting edge portions 50, 51 and 52, 53 (see FIG. 4) also add to the improvement in conversion efficiency especially in regard to panel 39. Again the light path from input area 43 to output area 47 is direct in that additional internal reflection as experienced along the non-parallel edge portions in the prior art Slagle device is eliminated.

It should be noted that the panels 38, 39, 40 along with their associated light input areas 42, 43, 44 and light output areas 46, 47, 48 form a coplanar light pipe. Keeping the light output area in the same plane as its corresponding light input area again minimizes the light path distance and the total number of internal reflections thereby improving conversion efficiency.

The configuration and placement of the light output areas described above also permits the use of separate photomultiplier tubes for each light output area. The use of separate phototubes results in several performance improvements. In prior art multi-field, single tube devices such as described in the above reference Slagle patent, light from multiple sensitive areas is funnelled into a single photomultiplier tube. Only a portion of the light sensitive area of the phototube is thereby utilized. The configuration of the present invention utilizes separate miniaturized phototubes preferably Hamamatsu type R1414 for each panel thereby utilizing the entire light sensitive area of the tube which results in an increase in signal-to-noise.

The miniaturized photomultiplier tubes permits the use of multiple tubes in conjunction with coplanar light transmitting panels. The use of separate phototubes and control circuits (described below) further eliminates the need of the shuttering assembly described in the above referenced Slagle patent thereby improving the reliability and ruggedness of the device.

Figure 7:
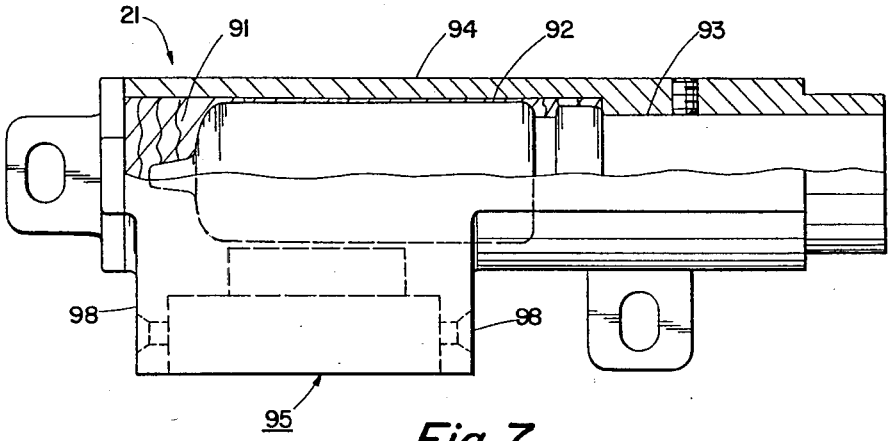
FIG. 7 is a detail view of the photomultiplier tube housing assembly.

A phototube housing assembly 21 is illustrated in FIG. 7. A photomultiplier tube 92 of the type described above is supported at its base end by a tube socket 93. The tube 92 and the tube socket 93 are mounted in a protective housing 94. Light from one of the light output areas 46, 47, 48 reaches the light sensitive area of the tube 92 through aperture 95 defined by a portion of housing 94. The area inside housing 94 surrounding tube 92 and socket 93 is filled with a potting compound 91 such as RTV silicon rubber to seal the entire assembly from moisture.

Figure 8A:
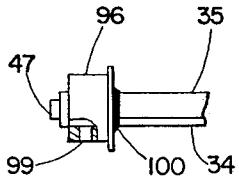
FIGS. 8A, B and C are detail views of the steps of assembling the phototube housing assemblies to the paddle housing assemblies.
Figure 8B:
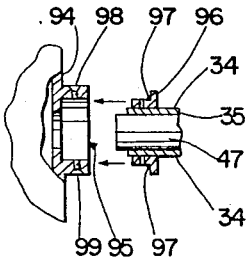
Figure 8C:
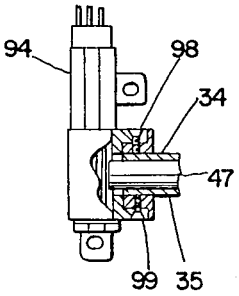

Referring to FIGS. 8A, B and C, the manner of assembling the photomultiplier housing assembly 21 to the phototimer assembly 20 is shown in greater detail. The center panel 39 and its associated light output area 47 and housing structure is shown as exemplary. It will be appreciated however that the following description applies equally well to light output areas 46 and 48. Referring to FIG. 8A, an external block 96 is slid over the tongue portion of output area 47 and surrounds covers 34, 35. External block 96 is secured in position by set screw 99. A continuous bead of black, plastic rubber 100, preferably methyl ethyl ketone with petroleum distillates, is injected in the cavity between the block 96 and the covers 34, 35 filling all voids. FIG. 8B details light output area 47 within covers 34, 35 and external block 96 prior to assembly to phototube housing 94. Just prior to assembly, a bead of black, plastic rubber 97 is formed around the base and flange face on four sides of the external block 96. The phototube housing assembly 94 is then slide over the external block 96 placing light output area 47 into aperture 95 resulting in optical coupling of the two. Light from output area 47 passes through aperture 95 and to the light sensitive area of photomultiplier tube 92. After mating, the resulting fit is to be a light tight, humidity proof seal. To complete the assembly, countersunk holes 98 are first coated with black, plastic rubber prior to insertion of flat head screws 99. Insertion of screws 99 secures the phototube housing assembly 94 to the phototimer assembly 20. The rubber provides a light tight and humidity proof seal (see FIG. 8C).

Assembly in this manner provides a light tight hermetically sealed structure for housing the complete phototimer assembly.

The various improvements described above, either by themselves or cumulatively result in substantial performance improvements over the prior art. Utilizing the benefits of all improvement results in over a ten time increase in conversion efficiency (absorbed x-ray to signal output) of the device over that of the device described in the above referenced Slagle patent. This increase in partially attributed to three times more efficient light transfer per channel resulting from the direct, coplanar light paths; two times more photocathode area used for light pickup; and two to three times more light generation per absorbed x-ray due to the use of lower attenuation styrene covers and mask and the higher conversion efficiency of the preferred rare earth fluorescent screen.

Figure 9:
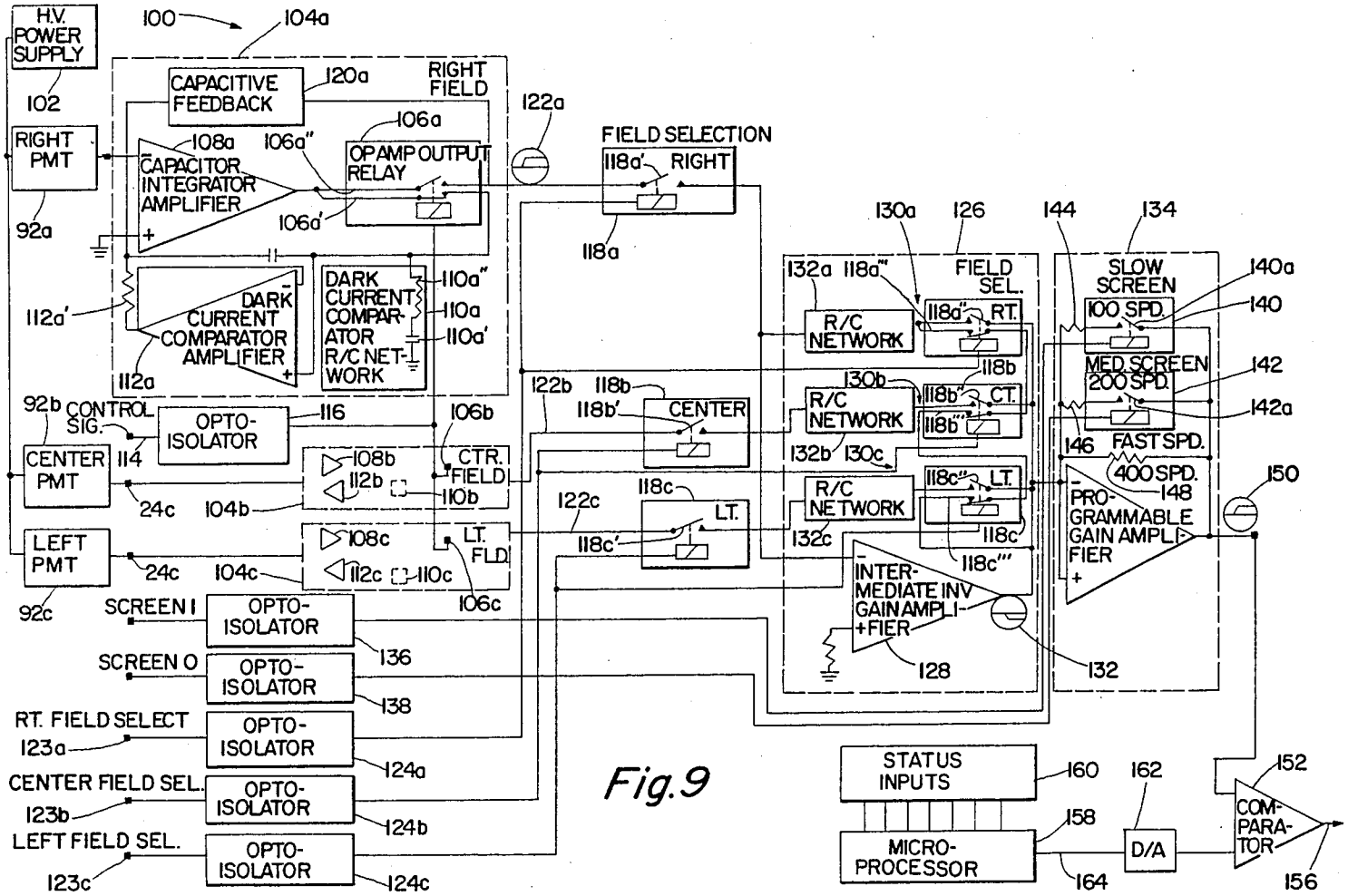
FIG. 9 is a partial block, partial schematic diagram of the control circuit of the present invention.

Referring now to FIG. 9, the control circuit 100 is shown in partial schematic/block form. In general, the control circuit comprises means for sampling dark current from each channel or field immediately preceding the exposure and correcting for this dark current during the exposure; means for selecting the desired combination of phototimer fields; means for mixing the signals from the selected channels; means for amplifying the mixed signals as a function of the selected field combination; means to gain factor the mixed signal as a function of the selected film/screen combination; means including a processor means to calculate the exposure reference level that compensates for system variables that would otherwise cause an incorrectly exposed film. These variables may include selected kVp at which the exposure will be taken, speed of the chosen film/scintillator screen combination, x-ray field size, patient size, and beam angle. Finally, a means is provided for comparing the gain factored signal, which is a voltage ramp with the calculated exposure reference level and outputting a signal suitable for terminating the x-ray exposure.

The electrical signal generating means, more fully described above in conjunction with the phototimer assembly 20, are shown at 92a, 92b and 92c. Each of the electrical signal generating means is preferably a photomultiplier tube (PMT) but can be other devices which generate an electrical signal proportional to the intensity of light or x-radiation incident thereon such as sensitive photo cells, photostrips or ion chambers. A three field phototimer (therefore three separate PMTs) is commonly employed. In operation any one of the fields, any combination of two fields or all three fields may be selected by the operator via field select switches located at control panel 22. The field or fields are selected by the operator dependent on specific anatomy and size of the area to be imaged. It is to be recognized however, that although three fields are preferred any number of fields can be utilized.

A high voltage power supply 102 supplies high voltage, typically 750 volts to each of the PMT's. In the preferred embodiment the high voltage is applied continuously to the PMTs during system operation. This assures optimum PMT stability and also reduces or eliminates moisture build-up in the PMT tube socket 93 (see FIG. 7). This aspect aids in the stability of the system through the wide range of environmental factors referred to above.

Each of the three PMTs 92a, 92b and 92c are respectively connected to separate integrate and offset circuitry 104a, 104b, 104c. The operation of each of the integrate and offset circuits are identical. While the following describes the operation of circuit 104a and its associated down-stream electronics, it is to be realized that the same description applies to circuits 104b and 104c as well. Further, the block identified as 104a includes a schematic representation of the integrate and offset circuit. The same type of circuitry comprises integrate and offset circuits 104b and 104c although now shown in the same detail.

It is known in the art that PMTs produce undesirable leakage or dark currents. Dark current is current that flows from the PMT in the absence of light. Also the op-amps that comprise the integrators exhibit a constant electrical offset current in the form of an op-amp input bias current and an input offset voltage. Without compensating for the cumulative effect of these stray signals, an inaccurate representation of the radiation incident on the phototimer assembly would result due to error in the integration of the phototimer signal.

The output of op-amp 108a is connected to two contact sets of an output relay 106a. In a standby or pre-exposure condition, output relay 106a is disabled. In this condition, relay contacts 106a' are normally closed thereby connecting the output of op-amp 108a to a dark current comparator R/C network 110a and dark current amp 112a. Contacts 106a'' are normally open thereby keeping a network 120a from forming a capacitive feedback circuit for op-amp 108a. In this configuration, any PMT dark current appearing on the inverting input of op-amp 108a will appear at its output and cause capacitor 110a' to charge through resistor 110a''. Capacitor 110a' will charge to the average value seen at the output of op-amp 108a. The R/C network 110a in combination with a dark current comparator amplifier 112a produce a compensating current at the output of amplifier 112a which is equal and opposite the sum of the PMT dark current and op-amp offsets. The compensating current appearing at the output of dark current comparator amplifier 112a is applied to the inverting input of op-amp 108a through resistance 112a' thereby holding the input of op-amp 108a at a virtual ground.

The dark current seen at the output of the PMTs is erratic over short time intervals. Due to the "spiky" nature of the dark current, it is important to choose a value for capacitor 110a' which will provide a sufficiently long time constant so that the dark current will be averaged over time. If the time constant is too short, the dark current compensation would be erratic in that it may compensate at the peak of a spike.

A further consideration is that dark current compensation should occur through an entire exposure interval. In some procedures the exposure interval may be upwards of 5 seconds. Choosing a capacitor large enough to provide compensation for this long an interval would be inherently leaky and not have good temperature stability. In order for the control circuit to be operable over a wide temperature range while maintaining compensation over a long exposure interval, dark current comparator amplifier 112a is utilized. Amplifier 112a acts to maintain the compensation for the desired interval thereby allowing the choice of a smaller value for capacitor 110a. A polystyrene capacitor has good stability over a wide temperature range and are available in values large enough ($\approx$1 uf) to achieve the averaging needed to avoid erratic compensation.

Upon initiation of an x-ray exposure by the operator, a control signal on line 114 enables output relay 106a thereby changing the state of contacts 106a' and 106a''. The control signal on line 114 is applied to relay 106a via opto-isolator 116. Opto-isolators are known in the art and are used to isolate the control circuit from spurious noise that may appear on the line 114 thereby improving the signal-to-noise ratio of the control circuit.

When contact 106a' opens, resistor 110a'' experiences a current reversal, i.e. capacitor 110a' discharges through resistor 110a''. The discharge of capacitor 110a' holds the dark current compensator 112a at a level just before exposure start thereby insuring that the input to the op-amp 108a remains at virtual ground at initiation of the exposure. The closing of contact 106a'' connects the output of op-amp 108a to contact 118a' of field select relay 118a whose function is explained in more detail below. The closing of contact 106a'' also connects capacitance feedback network 120a to the output of op-amp 108a creating an integrator circuit.

With the exposure initiated, radiation emanating from the tube passes through the subject under examination and impinges on the phototimer assembly 20. Fluorescene generated light is transmitted to each of the PMTs 92a, 92b, 92c. Each PMT produces an electrical signal 24a, 24b, 24c proportional to light received from its respective field. Thse signals are connected to their respective integrator circuits to create at the output a plurality of first positive-going ramp voltages 122a, 122b, 122c each proportional to the respective PMT anode current. Due to the action of the dark current comparator amplifier 112a, 112b and 112c in combination with their respective dark current comparator R/C networks 110a, 110b and 110c, each of the first positive going ramps generate a slope proportional to light intensity instead of a slope increased by PMT dark current.

Field select relays 118a, 118b, 118c are selectively enabled by the operator from the x-ray control panel 22 by field select pushbuttons. Any combination of any one, two or all fields may be made dependent on the anatomy and condition of the patient under examination. Upon selection of a given field or combination of fields, a field select signal appears on the appropriate one of lines 123a, 123b, or 123c. The field select signals are connected to each of the field select relays via opto-isolators 124a, 124b, and 124c.

Each field select relay has three contact sets. Referring to relay 118a, a first set of contacts 118a' operates to selectively connect the first ramp 122a, seen at the output of op-amp 108a, to an intermediate inverter gain amplifier circuit 126. Intermediate inverter gain amplifier circuit 126 includes op-amp 128 and three selectable feedback networks 130a, 130b, 130c. Feedback network 130a is selectively connected in feedback to op-amp 128 via second and third field select contacts 118a'' and 118a'''. Feedback networks 130b and 130c are likewise selectively connected in parallel, to op-amp 128 via relay 118b and its associated contacts 118b'', 118b''' and relay 118c and its associated contacts 118c'', 118c''' respectively. The selective connection of one or more feedback network in parallel to op-amp 128 modifies the gain of circuit 126 to correspond to the number of phototimer fields selected by the operator. For example, selection of the field corresponding to PMT 92a causes contacts 118a' and 118a'' to close and 118c''' to open thereby connecting the output of integrator and offset circuit 104a to the input of inverter gain amplifier circuit 126. R/C network 130a is connected in feedback to op-amp 128 and determines its gain. With a single field chosen, op-amp 128 with R/C network 130a in feedback provides a $\times 1$ gain to a single ramp input. The same hold true if a single field corresponding to PMT 92b or 92c is chosen. With two fields selected, e.g., PMTs 92a and 92b, first ramps 122a and 122b are selectively applied to intermediate inverter gain amplifier circuit 132. Two R/C networks 130a, 130b are connected in parallel and create the feedback network to provide a $\times \frac{1}{2}$ gain factor. With all three fields chosen, first ramps 122a, 122b and 122c are selectively applied to the intermediate inverter gain amplifier circuit 126. Three R/C network 132a, 132b and 132c are connected in parallel and create the feedback loop to provide a $\times \frac{1}{3}$ gain factor.

Normal closed contacts 118a''', 118b''' and 118c''' are connected in series with R/C network 132a. This arrangement maintains R/C network 132a in the feedback loop of gain amplifier 128 in the event the operator fails to select at least one field in order to maintain circuit stability.

Op-amp 128 produces a negative going, second ramp signal 132 at its output which is proportional to incident radiation on the selected phototimer fields. The gain amplifier 126, dependent on the field or fields chosen by the operator, sees a single or multiple first ramps at its input. The gain amplifier 126 produces a single, inverted second, ramp 132, proportional to the combined response of the selected fields. Thus, intermediate inverter gain amplifier circuit 126 effects a mixing of the ramp signals from the selected field PMTs and compensates the gain of the mixed signal as function of the number of fields selected.

The output of the intermediate inverting gain amplifier 126 is connected to programmable gain amplifier circuit 134 where the second ramp signal 132 is again inverted to a positive going form. The gain of the programmable gain amplifier circuit 134 is varied to compensate for various x-ray film and intensifier screen sensitivities which form a part of the x-ray film cassette 19. Gain selection is controlled by the operator who selects the film/screen combination to be used at the x-ray control panel 22. Relays 140 and 142 are selectively enabled by the operator from the x-ray control panel 22 by screen select switches. Two screen select switches (not shown) are available which result in 3 screen combinations. If neither film screen 1 (100 speed) nor film screen 0 (200 speed) is selected, gain is controlled by resistor 148 corresponding to the fast (400 speed) screen and a $\times 4$ gain results. A film screen 0 selection enables relay 142 through opto-isolator 138 closing normally open contact 142a resulting in connection of resistor 146 in parallel with resistor 148 producing a $\times 2$ gain. This selection corresponds to a medium or 200 speed film/screen combination. A film screen 1 selection enables relay 140 through opto-isolator 136 closing normally open contact 140a resulting in connecton of resistor 144 in parallel with resistor 148 producing a $\times 1$ gain. This selection corresponds to a slow or 100 speed film screen combination. Opto-isolators 136 and 138 again isolate the control circuitry from noise generated in the control panel 22.

The programmable gain amplifier circuit 134 thus produces a positive going gain compensated third ramp signal 150 at its output which is fed to one of the inputs of comparator 152. The third ramp 150 is compared with a reference signal 154. When the magnitude of the ramp 150 equals the level of the reference signal 154, the comparator 152 produces a termination signal 156. The comparator 152 is connected to the x-ray control 22 and the termination signal 156 is effective in terminating the x-ray exposure.

Figure 10:
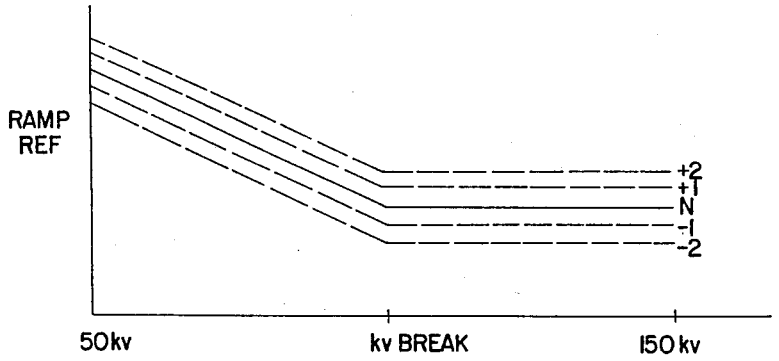
Fig. 10 PRIOR ART
FIG. 10 is a graphical representation of a prior art kV compensation scheme.

The manner in which the reference signal is produced is described with reference to FIGS. 10 and 11.

Certain system variables can affect the performance of the phototimer system and result in inconsistent film density over the possible system exposure configurations. These variables preferably include selected kVp, patient thickness, selected film density, x-ray field size, x-ray tube focal spot size, and x-ray beam angle. Although the following description discusses only these variables, it will be seen that practically any system variable can be compensated for by the method and apparatus of the present invention. By correcting the reference signal as a function of the cumulative effect of the chosen variables, optimized exposures with consistent film density and image contrast will result.

The first and most important variable to be considered is the kVp, selected by the operator at control panel 22, at which the exposure is to be taken.

In a prior art system, a reference signal was determined as a linear function of selected kVp. That is, for a given range of selecteable kVp, e.g., 50–75 kVp, the value of the reference signal declined linearly as selected kVp increases (see FIG. 10). Over a second range, e.g. 76–150 kVp, the value of the reference signal remained constant. The slope of the reference signal v. kVp curve for the first range was adjustable as was the "break-point" between the first and second range.

It is also known to provide the operator with a "density" select capability. A selector switched on the x-ray control allowed the user to adjust the desired film density in a number of ranges, e.g., −1, 0, +1 which varied the film exposure from −29% to +41% of the normal reference. The density variation was achieved by shifting the reference signal v. kVp curve up or down by a factor corresponding to the desired density variation (see FIG. 10).

With the advent of high speed, rare earth screens, it has been found that the simple linear relationship between the reference signal and selected kVp does not satisfactorily compensate the reference signal for variation in screen output. Also it has been found that breaking the relationship down into more than two regions results in finer control and better definition of the relationship.

Figure 11:
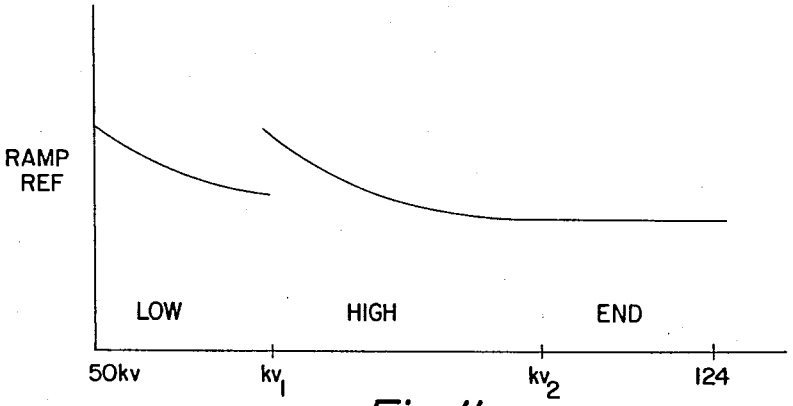
FIG. 11 is a graphical representation of the kV compensation scheme of the present invention.

Referring to FIG. 11 the compensation scheme of the present invention is shown in more detail. The desired reference signal is plotted as a function of selected kVp. The relationship is broken down into preferably three regions labeled "LOW", "HIGH" and "END." The relationship in the LOW and HIGH region is defined by two quadratic equations. The relation in the END region is defined by a linear equation.

The selectable kV range for a general purpose radiographic system is commonly 50–150 kVp although any reasonable range, in practice, can be chosen. For the purposes of the following discussion, however, the range of 50–125 kVp is used.

As described above, the kV reference curve for the LOW and HIGH region is preferably defined by two quadratic equations in the form;

$$ax^2+bx+c$$

although higher order equation may be used as well. The variable of each such equation is defined by KV COUNT, where $$KV\ \text{COUNT}=\text{selected}\ kVp-50 \qquad (1)$$

The break points, shown at KV1 and KV2 on FIG. 11 are points roughly corresponding to the K edge of the screens and are chosen to best fit the measured response of the completed system. If $0<KV\ \text{COUNT}\leqq KV1$ the system is operating in the LOW kV range and equation 2 described below, will define the compensation curve. If $KV1<KV\ \text{COUNT}\leqq KV2$, then the system is operating in the HIGH kV range and equation 3 described below, will define the compensation curve. If KV2<KV count, then the system is operating in the END kV region and equation 4 described below, defines the compensation curve.

The coefficients of each of equations 2, 3, and 4 are values representative of the speed of a selected film/screen combination. It has been found that the relationship between selected kVp and different film/screen combinations can create substantial variation in film contrast if not properly compensated. For example, if a SLOW speed screen (screen 1) is selected in the LOW kV range, then coefficients defined as SCR1 LOW2; SCR1 LOW1; and SCR1 LOW0 are selected. For the medium speed screen (screen 2), coefficients defined as SCR2 LOW2; SCR2 LOW1; and SCR2 LOW0 are selected. For the FAST speed screen (screen 3), coefficients defined as SCR3 LOW2; SCR3 LOW1; SCR3 LOW0 are selected.

If the selected kVp falls within the HIGH range, the coefficients then become;

- if screen 1 selected: SCR1 HIGH2; SCR1 HIGH1; SCR1 HIGH0,
- if screen 2 selected: SCR2 HIGH2; SCR2 HIGH1; SCR2 HIGH0,
- if screen 3 selected: SCR3 HIGH2; SCR3 HIGH1; SCR3 HIGH0.

Therefore, for each of the LOW and HIGH kVp ranges, nine separate coefficients are defined.

From the above, the equation defining the kV ramp reference (KVRMPREF) for the LOW kV range can then be defined as;

$$KVRMPREF=((SC\#\text{LOW}\ 2*KV\ \text{COUNT}+SC\#\text{LOW}\ 1)*KV\ \text{COUNT}+SC\#\text{LOW}\ 0) \qquad (2)$$

where SC# is replaced by either SC1, SC2 or SC3 depending on the screen speed selected by the operator.

The equation defining the kV ramp reference (KVRMPREF) for the HIGH kV range is likewise defined as;

$$KVRMPREF=((SC\#\text{HIGH}\ 2*KV\ \text{COUNT}+SC\#HIGH\ 1)*KV\ \text{COUNT}+SC\#\text{HIGH}\ 0) \qquad (3)$$

where SC# is replaced by either SC1, SC2 or SC3 depending on the screen speed selected by the operator.

The equation defining the kV ramp reference (KVRMPREF) for the END range is simply defined by;

$$\text{KVRMPREF}=\text{SC\#END} \qquad (4)$$

which is a predetermined constant value depending on the screen speed chosen (SC1, SC2 or SC3). Equation (4) defines the special case of a linear relationship with zero shape. It is to be realized however that the linear relationship in the END region may be shaped although in practice such shape has been found to be quite small.

It is also to be noted that break points, KV1 and KV2, may be discontinuous. That is, the kV ramp reference for a selected kV slightly below KV1 may be less than the kV ramp reference for a selected kV slightly above KV1. The discontinuous nature is shown at KV1 in FIG. 11. Selection of coefficients may however, cause the kV ramp reference to exhibit a continuous relationship over the transition from one kV range to the next. This relationship is exhibited at KV2 in FIG. 11. What is to be realized is that the break points and the coefficients are chosen to best fit the measured response of a particular system configuration and that discontinuities in the final curve set may or may not result.

Once the kV correction curves are determined, additional compensation for other system variables is achieved by applying a series of scaling factors to the curve set which adjusts the entire set up or down. The coefficients of each of the equations are determined empirically and the scaling factors are calculated using a series of scaling factor equations defined below.

The manner in which the coefficients are determined is explained in more detail below.

Variation in the cross-sectional area of the radiation beam as defined by collimator 29 is compensated by varying the kV ramp reference curve set up or down in a linear fashion with respect to selected collimator size. A collimator size scaling factor, defined as COLSZREF, is calculated as follows;

*COLSZREF*=*COL* SIZE 1**COL* AREA+*COL* SIZE 0 (5)

where the variable COL AREA is the cross-sectional area of the radiation beam as defined by the selected field size at the collimator 29. Equation 5 thus defines a linear relationship between the scaling factor COLSZREF and the cross-sectional area of the beam.

As described above, the operator has available a density select capability. The operator may choose +1, 0 or −1 density although in some system five or more levels are provided. The density scaling factor, defined as DENSREF is a constant determine as follows;

If selected density=+1 then DENSREF=DENSITY 2 (6)

If selected density=0 then DENSREF=DENSITY 1 (7)

If selected density=−1 then DENSREF=DENSITY 0 (8)

Modern x-ray tubes typically have a variety of focal spot sizes to choose from depending on the resolution desired and the tube loading required for a particular examination. The selected focal spot size scaling factor is defined by FS REF. Typically, a small and large focal spot is available for selection and FS REF is determined as follows;

If selected focal spot size=small, then FS REF=FSSML (9)

If selected focal spot size=large, then FS REF=FSLRG (10)

Differences in thickness of the various patients undergoing examination is also accounted for. The patient thickness scaling factor is defined as PATTHREF. The scaling factor is determined by;

*PATTHREF*=(*PATTH* 2*BODY THICKNESS+PATH 1)*BODY THICKNESS+PATH 0 (11)

where BODY THICKNESS is actual measure body thickness. Equation 11 thus defines a quadratic relationship between PATTHREF and the actual patient body thickness.

Variations in source or beam angle are compensated for as well. Beam angle is adjustable ±90° (see FIG. 1) and the scaling factor is defined as SCRANREF.

If SRCANGLE≦15 then SRCANGREF=SRCANG 0 (12)

If SRCANGLE>15 then SRCANGREF=SRCANG 1 (13)

where SRCANGLE is the measured source angle.

The scaled ramp reference signal, defined as RAMP REF, is determined by a multiplication of the kV ramp reference value (KVRMPREF) determined by kV ramp reference equations (equations 2, 3 and 4), by each of the above defined scaling factors to yield the following;

RAMP REF=KVRMPREF*COLSZREF/1024*CALREF/1024*DENSREF/1024*FS REF/1024*PATTHREF/1024*SRCANGREF/1024*131/1024 (14)

Each term is divided by 1024 in order to normalize each factor to 1024 or 16 bits. The last term (131/1024) scales RAMP REF to the appropriate 8-bit signal for D/A conversion as described in more detail below.

The following table 1 lists exemplary values of each of the coefficients defined for equations 2 through 13.

TABLE 1

| | Name | Initial Value |
|---|---|---|
| 1. | SC1LOW2 | 0 |
| 2. | SC1LOW1 | 0 |
| 3. | SC1LOW0 | 1011 |
| 4. | SC1HIGH2 | 103 |
| 5. | SC1HIGH1 | −2840 |
| 6. | SC1HIGH0 | 1011 |
| 7. | SC1END | 860 |
| 8. | SC1KV1 | 0 |
| 9. | SC1KV2 | 12 |
| 10. | SC2KLOW2 | 103 |
| 11. | SC2LOW1 | −3285 |
| 12. | SC2LOW0 | 1273 |
| 13. | SC2HIGH2 | 0 |
| 14. | SC2HIGH1 | −261 |
| 15. | SC2HIGH0 | 1105 |
| 16. | SC2END | 955 |
| 17. | SC2KV1 | 12 |
| 18. | SC2KV2 | 74 |
| 19. | SC3LOW2 | 93 |
| 20. | SC3LOW1 | −8795 |
| 21. | SC3LOW0 | 2894 |
| 22. | SC3HIGH2 | 0 |
| 23. | SC3HIGH1 | −435 |
| 24. | SC3HIGH0 | 1444 |
| 25. | SC3END | 1193 |
| 26. | SC3KV1 | 50 |
| 27. | SC3KV2 | 74 |
| 28. | COLSIZE1 | 44 |
| 29. | COLSIZE0 | 992 |
| 30. | CALDEFELT | 1024 |
| 31. | CALSET | 1024 |
| 32. | DENSITY0 | 724 |
| 33. | DENSITY1 | 1024 |
| 34. | DENSITY2 | 1448 |
| 35. | FS LRG | 1024 |
| 36. | FS SML | 1024 |
| 37. | PATTH2 | 0 |
| 38. | PATTH1 | 0 |
| 39. | PATTH0 | 1024 |
| 40. | RMPREEMX | 255 |

TABLE 1-continued

| | Name | Initial Value |
|---|---|---|
| 41. | RMPREEMN | 12 |
| 42. | SRCANG1 | 1024 |
| 43. | SRCANG0 | 1024 |

Referring back to FIG. 9, the manner in which the above described correction scheme is implemented is described. The block 158 identified as microprocessor includes a 68000 microprocessor plus various storage means, such as look-up tables and memory which are used to store the various equations and Table 1 coefficients used in the correction scheme. The microprocessor 158 receives status inputs from various system components shown generally at block 160. The status inputs, determined at the operator control panel 22 and other components of the system, e.g., collimator, define the system variables for use in each of equations 2 through 13.

Equations 1 to 14 are stored in a first storage means. A second storage means, preferrably a look-up table, stores the Table 1 coefficients. Both storage means are accessible by the microprocessor for further processing.

In operation, the microprocessor 158 monitors the various status inputs from the system components. During exposure setup, the operator selects at control panel 22 a screen speed, SC1, SC2 or SC3; a kVp to be used during the examination, and a film density (+1, 0 or −1). Also the collimator is adjusted to correspond to selected film size and the source angle adjusted as required. Based on these selections, a kV ramp reference can be defined. In accordance with equation 1, the selected kVp determines in which one of the three regions the compensation scheme will lie, e.g., equations 2–4 are used in the kV ramp determination. The coefficients corresponding to the selected screen speed residing in the second storage means are accessed and used by the microprocessor to calculate the kV ramp reference value (KVRMPREF).

The other systems variables are also monitored. Coefficients corresponding to the selected system variable are also accessed from the Table 1 values in the second storage means. These variables and coefficients are applied to equations 5–13 respectively to derive the scaling factors. Each scaling factor is 16 bit normalized to 1024. The normalized scaling factors are each multiplied to the kV ramp reference value determined above (and then divide by 1024 to prevent overflow on the 16 bit integers) to derive a scaled digital ramp reference value. This digital ramp reference signal, shown at 164 in FIG. 9, is outputted from the microprocessor.

In an alternative embodiment to the present invention, a plurality of kV ramp reference values can be calculated for a given film/screen selection. For example, values can be calculated at two kV increments. The kV ramp reference values defining the kV ramp reference curves are stored in a look-up table at locations whose address is the corresponding kV. Upon selection of a kVp by the operator, the kV ramp reference is "looked-up" in the table and then utilized as before.

Digital to analog converter 162 converts the digital ramp reference signal 164 to analog referenced signal 154 which is in turn connected to the second input of comparator 152. The time increasing third ramp 150 is compared with reference signal 154. When ramp 150 reaches a value equal to reference 154, comparator 156 produces a termination signal 156 effective to terminate the exposure.

From the above description it can be clearly seen that the reference signal 154 can be derived to compensate for virtually any system variable that effects image quality. Other equations defining a relationship between image quality and other system variables can be defined along with additional coefficients. The effects on image quality caused by changes in the system configuration can be determined empirically and coefficients added to table 1 accordingly.

In general, the method used to determine the coefficients to be used in the RAMP REF calculations is to make a series of film exposures while varying the particular system parameter to be compensated, measure the density of the films and plot the film density versus the parameter to be compensated. From the plot, one can determine what effect a variation in the parameter will have on film density. The relationship between the two can be correlated to a scaling function that modifies the ramp reference value by an amount that will achieve the normalized film density over the range of variation of the system parameter being considered.

Figure 12:
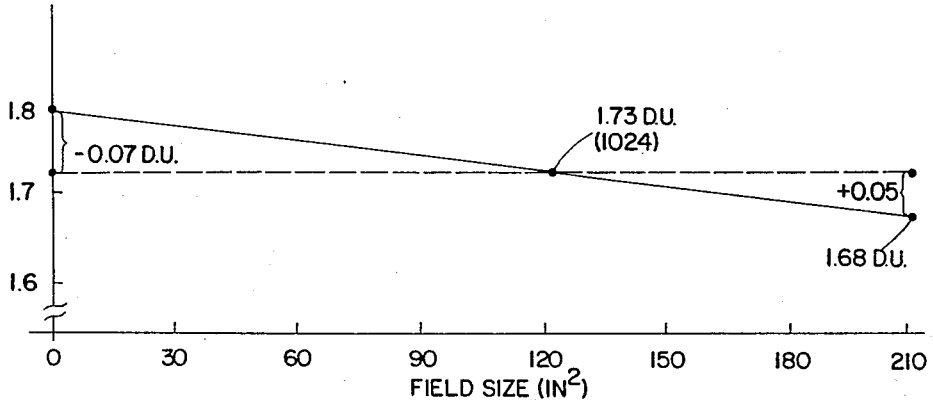
FIG. 12 is a graphical representation of variation in film density as a function of beam area.

For example, FIG. 12 represents a plot of the variation in film density as a function of beam area or collimator size. It is seen from this graph that as the collimator size is increased, the exposure density decreases in a substantially linear fashion. In order to achieve uniform film density over the entire range of x-ray field size, the curve must be corrected or scaled by factors determined by the particular film characteristics.

A point, central to the curve (e.g., 120 $in^2$) is chosen and becomes the reference point. This point is assigned a value of 1024. It is seen from the FIG. 12 plot that in order for the film density at 0 $in^2$ to be normalized to 1024, the curve must be shifted downward by 0.07 density units. Likewise, in order for the film density at 210 $in^2$ to be normalized to 1024, the curve must be shifted upward by 0.05 density units. In order to correlate the density shift required with an exposure parameter (i.e., reference signal) the optical characteristics of the film being used must be investigated.

Figure 13:
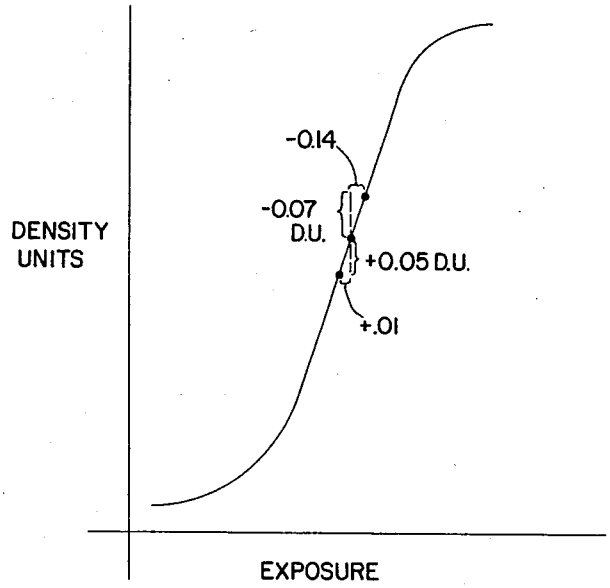
FIG. 13 is a graphical representation of the optical sensitivity of a particular type of x-ray film.
Figure 14:
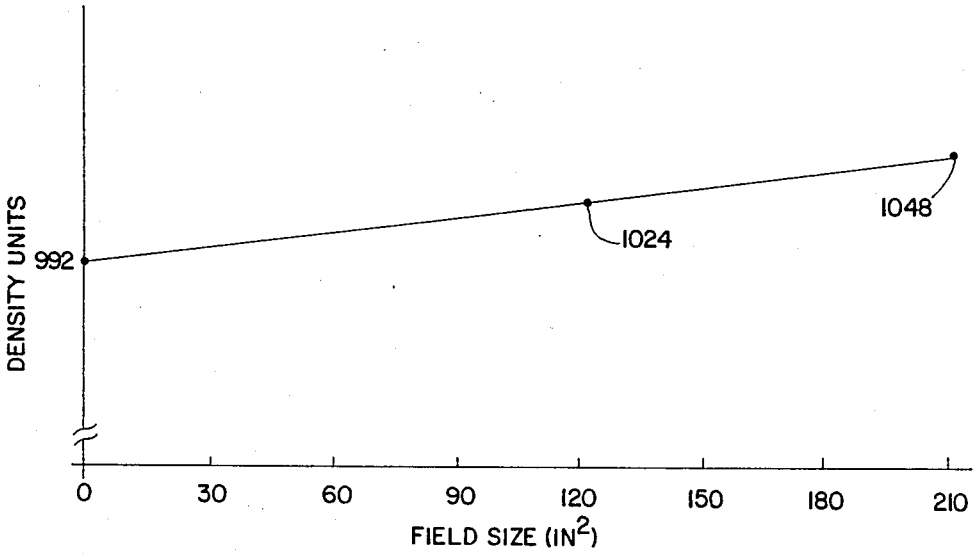
FIG. 14 is a graphical representation of a compensation curve for variations in x-ray field size.

FIG. 13 is a representative D log E curve for a particular type of x-ray film. A sensitometer is used to expose the film, in steps, to predetermine levels of light intensity. The film density is measured at each step and a plot of the optical sensitivity of film can be created.

Referring back to FIG. 12 it is seen that at the central point of 120 $in^2$, the corresponding density value is approximately 1.73 density units. From the D log E curve, (FIG. 13), the log of the exposure differential required to achieve a density reduction of 0.07 density units is approximately −0.014. A ratio of $10^{\log E}$ or $10^{-0.014}=0.968$ is multiplied with 1024 in order to arrive at a 992 value at 0 $in^2$ field size.

In like fashion, the log of the exposure differential required to achieve a density increase of 0.05 density units is approximately +0.01. Again a ratio of $10^{\log E}$ or $10^{+0.01}=1.023$ is multiplied with 1024 to arrive at a 1048 value at 210 $in^2$ field size.

With the corrected values determined in accordance with the above, a compensation curve can be plotted. The equation defining this compensation curve is equation (5) defined above and where COL SIZE 0 is the zero intercept of the compensation curve or 992 and COL SIZE 1 is the shape of the curve or 44.

It is to be realized that the above described calibration procedure is exemplary and is described for the purpose of providing insight into the manner in which the coefficients comprising table 1 are derived. Variations in methodology and results may occur which will achieve the intended result of the invention as described herein.

The invention has been described with reference to the preferred embodiment. Obviously, modifications and alterations will occur to others upon reading and understanding the preceding detailed description of the preferred embodiment. It is intended that the invention be construed as including all such alterations and modifications insofar as they come within the scope of the appended claims or equivalent thereof.

Having thus described the preferred embodiment, the invention is now claimed to be:

1. An x-ray imaging system including a source for emitting a beam of radiation along a path, an image receptor assembly spaced from the source and positioned in the beam path, said image receptor including a film and intensifier screen combination, a beam limiting device for delineating the perimeter of the radiation beam to a size approximating the size of the image receptor, a patient support positioned in the beam path between the source and image receptor, radiation generation means for energizing the source to emit radiation during an exposure interval, a phototimer means including a plurality of light sensitive electrical signal generation means said phototimer means at least partially positioned in the beam path between the patient support and image receptor for sensing radiation passing through a patient under examination and for producing separate electrical signals representative of radiation impinging on selected areas of said image receptor, and control means coupled to the phototimer means and to the radiation generation means for producing a termination signal effective to terminate the emission of radiation from the source, said control means comprising;

(a) integrator means for separately integrating each of said electrical signals over the exposure interval to produce first ramp signals;

(b) dark current compensation means for separately sampling dark current produced by the light sensitive electrical signal generation means preceding the initiation of the exposure interval and for separately correcting said first ramp signals as a function of sampled dark current;

(c) switching means connected to the integrator means for selecting at least one of said dark current corrected ramp signals;

(d) mixing means connected to the switching means for combining said selected dark current corrected ramp signals to produce a mixed ramp signal;

(e) amplifier means for amplifying said mixed ramp signal as a function of the number of said dark current corrected ramp signals selected to produce a second ramp signal;

(f) gain selection means connected to the mixing and amplifier means for multiplying the gain of said second ramp signal by a factor corresponding to characteristics of the film and intensifier screen combination to produce a third ramp signal;

(g) processor means for determining an exposure reference signal based on at least one exposure affecting system variable; and (h) comparator means connected to the gain selection means and the processor means for comparing said third ramp signal with said exposure reference signal and outputting a termination signal coupled to the radiation generation means effective to terminate the emission of radiation from the source.

2. An x-ray imaging system including a source for emitting a beam of radiation along a path, an image receptor assembly spaced from the source and positioned in the beam path, said image receptor including a selected film and intensifier screen combination, a beam limiting device for delineating the perimeter of the radiation beam to a size approximating the size of the image receptor, a patient support positionable in the beam path between the source and image receptor, a radiation generation means for energizing the source at a selected kVp to emit radiation during an exposure interval, a phototimer means at least partially positioned in the beam path between the patient support and image receptor for sensing radiation passing through a patient under examination and for producing an electrical signal proportional to radiation impinging on said image receptor, and control means coupled to the phototimer and to the radiation generation means for producing a termination signal effective to terminate the emission of radiation for the source, said control means comprising;

(a) integrator means for integrating said electrical signal over the exposure interval;

(b) dark current compensation means for sampling phototimer dark current preceding the commencement of the exposure interval and for correcting said integrated electrical signal as a function of sampled dark current;

(c) gain selection means for producing a gain selected signal by multiplying said corrected integrated signal by a factor corresponding to characteristics of the film and intensifier screen combination;

(d) exposure reference level signal generating means comprising:

(i) first storage means for storing a plurality of kV compensation curve equations where each equation is a function of the selected kVp and each equation has coefficients which are values corresponding to characteristics of selected film and intensifying screen combinations;

(ii) second storage means for storing values representing the characteristics of a plurality of different film and intensifying screen combinations; and (iii) processor means for accessing the first and second storage means and for developing an exposure reference level signal based on one of said kV compensation curves and values representing the characteristics of one of said plurality of different film and intensifying screen combinations; and (e) comparator means for comparing said gain selected signal with said exposure reference level signal and outputting a termination signal effective to terminate the emission of radiation from the source.

3. In a diagnostic x-ray imaging system having radiation generation means for energizing an x-ray source at a selected kVp, an x-ray method of automatically controlling the duration of x-ray exposure of a subject under examination to obtain x-ray images having a desired density wherein an exposure is terminated by deactivating the x-ray source in response to a comparison being made with a comparator between a signal that increases in magnitude with time in proportion to x-ray dose emergent from the subject under examination and impinging on an image receptor having a film and intensifier screen combination and a reference signal defining the net effect of a plurality of predetermined system variables, said method comprising the steps of;

(a) storing in a first memory means
  (i) a first set of equations defining kV reference curves being functions of selected kVp and values representative of film and screen speed as coefficients, and
  (ii) a second set of equations defining scaling factors based on predetermined system variables including at least one of x-ray beam size, selected image density, patient thickness, focal spot size, and source angle;

(b) storing in a second memory means
  (i) a plurality of coefficients representative of film and screen speed, and
  (ii) a plurality of coefficients representative of said predetermined system variables;

(c) selecting a kVp, a film and screen speed and at least one system variable at which the x-ray exposure is to be taken;

(d) selecting from the first memory means a kV reference curve equation based on the selected kVp;

(e) selecting from the second memory means coefficients corresponding to the selected film and screen speed;

(f) determining a kV ramp reference by applying the selected coefficients to the selected kV reference curve equation wherein the selected kVp value is its variable;

(g) selecting from the second memory means at least one set of coefficients corresponding to selected system variables;

(h) determining at least one scaling factor by applying said coefficients selected in step (g) to the respective one of the second set of equations;

(i) multiplying the kV ramp reference by each of said scaling factors to produce a digital reference signal;

(j) converting the digital reference signal to an analog reference signal; and (k) simultaneously comparing said analog reference signal and said time increasing signal and producing a signal effective to terminate said exposure when the time increasing signal equals said analog reference signal.

4. The method of claim 3 wherein said kV reference curves define first, second, and third kV correction regions.

5. The method of claim 4 wherein one of said kV correction curves defining said first kV correction region defines a portion of a parabola.

6. The method of claim 4 wherein one of said kV correction curves defining said second kV correction region defines a portion of a parabola.

7. The method of claim 4 wherein one of said kV correction curves defining said third kV correction region defines a straight line.

8. Automatic exposure control means for use with a diagnostic imaging system comprising a penetrative radiation source for projecting a beam of radiation along a path, power supply means for energizing the radiation source including means for selecting the kilovoltage to be applied to the radiation source during energization, a radiation detector interposed in the beam path including a film and intensifying screen combination, said automatic exposure control means comprising;

(a) a phototiming paddle means at least partially interposed in the beam path between the source and the radiation detector, said paddle means comprising a plurality of electrical signal generating means for generating separate electrical signals in response to radiation incident on selected areas of said radiation detector, said electrical signal generating means also producing a leakage current in the absence or presence of incident radiation;

(b) offset means for correcting said electrical signals for leakage currents produced by said electrical signal generating means to produce corrected electrical signals;

(c) integrator means for separately integrating each of said corrected electrical signals during an exposure to produce first ramp signals;

(d) signal select means coupled to the integrator means for selecting at least one of said first ramp signals;

(e) mixing means coupled to the signal select means for combining said selected first ramp signals to form a mixed signal and for dividing said mixed signal by a factor proportional to the number of said first ramp signals selected to form a second ramp signal;

(f) gain select means coupled to the mixing means for varying the gain of the second ramp signal by a factor corresponding to the speed of different film and intensifying screen combinations to produce a third ramp signal;

(g) reference level generator means for producing a reference signal; and (h) comparator means for comparing said reference signal with said third ramp signal and for producing a termination signal effective to terminate the energization of said radiation source.

9. The automatic exposure control means of claim 8 wherein said reference signal generator means further comprises;

(a) first storage means for storing a plurality of kV compensation curve equations being functions of selected kVp and each equation has coefficients which are values corresponding to characteristics of a selected film and intensifying screen combination;

(b) second storage means for storing digital data values representing the characteristics of a plurality of different film and intensifier screen combinations;

(c) processor means capable of accessing the first and second storage means for developing a kV ramp reference signal based on one of said plurality of kV compensation curves and digital data values representing the characteristics of one of said plurality of different film and intensifier screen combinations; and (d) digital-to-analog conversion means for converting said kV ramp reference signal to an analog reference signal.

10. The automatic exposure control means of claim 9 wherein;

(a) said first storage means includes means for storing a plurality of scaling factor equations;

(b) said second storage means includes means for storing plurality of values representative of predetermined system variables;

(c) said processor means includes;
  (i) means for developing scaling factors based on said scaling factor equations and said values representative of predetermined system variables; and (ii) means for multiplying said kV ramp reference by said scaling factors.

11. In a diagnostic x-ray imaging system having radiation generation means for energizing an x-ray source at a selected kV, apparatus for automatically controlling the duration of x-ray exposure of a subject under examination to obtain x-ray images having a desired density wherein an exposure is terminated by deactivating the x-ray source in response to a comparison being made with a comparator between an integrated signal that is proportional to x-ray dose emergent from the subject under examination and incident on an image receptor having a film and intensifying screen combination and a reference signal defining the net effect of a plurality of predetermined system variables, said apparatus comprising;

(a) means for storing a plurality of sets of digital values respectively representing the characteristics of different film and intensifying screen combinations;

(b) means for storing a set of kV compensation equations whose coefficients are represented by said sets of digital values and the equations are functions of the value kV;

(c) processor means for developing reference values defining a set of kV compensation curves for each of said sets of digital values as a function of selectable kV values;

(d) memory means for storing said reference values at locations whose addresses correspond to selectable kV values;

(e) means for selecting a kV at which it is desired to make an exposure resulting in calling up the location of the reference value to which the selected kV relates;

(f) digital-to-analog conversion means to convert the reference value corresponding to the selected kV into a corresponding analog reference signal; and (g) comparator means operative to compare the integrated signal with the analog reference signal and to produce a signal effective to terminate the exposure when the two signals are equal.

12. The apparatus of claim 11 additionally comprising;

(a) means for storing a plurality of sets of digital values respectively representing predetermined system variables including radiation beam size, selected image density, thickness of the subject under examination, x-ray tube focal spot size, and beam angle;

(b) means for storing a plurality of scaling factor equations;

(c) processor means for developing scaling factors by applying a set of digital values to a corresponding scaling factor equation; and (d) means for multiplying said reference values by said scaling factors.

13. An x-ray imaging system including a source for emitting a beam of radiation along a path, an image receptor assembly spaced from the source and positioned in the beam path, said image receptor including a selected film and intensifier screen combination, a beam limiting device for delineating the perimeter of the radiation beam to a size approximating the size of the image receptor, a patient support positionable in the beam path between the source and image receptor, a radiation generation means for energizing the source at a selected kVp to emit radiation during an exposure interval, a phototimer means at least partially positioned in the beam path between the patient support and image receptor for sensing radiation passing through a patient under examination and for producing an electrical signal proportional of radiation impinging on said image receptor, and control means coupled to the phototimer and to the radiation generation means for producing a termination signal effective to terminate the emission of radiation for the source, said control means comprising;

(a) integrator means for integrating said electrical signal over the exposure interval;

(b) exposure reference level signal generating means comprising:

(i) first storage means for storing a plurality of kV compensation curve equations whose variables are selected kVp and whose coefficients are values corresponding to characteristics of selected film and intensifying screen combinations;

(ii) second storage means for storing values representing the characteristics of a plurality of different film and intensifying screen combinations; and (iii) processor means for accessing the first and second storage means and for developing an exposure reference level signal based on one of said kV compensation curves and values representing the characteristics of one of said plurality of different film and intensifying screen combinations; and (c) comparator means for comparing a gain selected signal which is a function of said integrated electrical signal with said exposure reference level signal and outputting a termination signal effective to terminate the emission of radiation from the source.

* * * * *